US005667641A

United States Patent [19]

Poirier et al.

[11] Patent Number: 5,667,641

[45] Date of Patent: Sep. 16, 1997

[54] APPLICATION OF THERMAL BARRIER COATINGS TO PAPER MACHINE DRYING CYLINDERS TO PREVENT PAPER EDGE OVERDRYING

[75] Inventors: Nicole A. Poirier, Beaconsfield; Peter G. Tsantrizos, Westmount, both of Canada

[73] Assignees: Pulp and Paper Research Institute of Canada, Pointe Claire; Pyrogenesis Inc., Montreal, both of Canada

[21] Appl. No.: 546,953

[22] Filed: Oct. 23, 1995

[51] Int. Cl.[6] ..... D21F 5/02

[52] U.S. Cl. ..... 162/207; 34/307; 34/311; 162/375; 427/453; 492/46; 492/53

[58] Field of Search ..... 162/375, 359.1, 162/207; 492/46, 53; 165/89; 34/110, 124, 307, 311; 427/453, 284

[56] References Cited

U.S. PATENT DOCUMENTS

| | | | |
|---|---|---|---|
| 4,192,080 | 3/1980 | Irpola | 34/307 |
| 4,379,369 | 4/1983 | Schiel | 34/110 |
| 4,399,169 | 8/1983 | McGowan | 427/284 |
| 4,450,631 | 5/1984 | Gamble | 34/110 |
| 4,639,291 | 1/1987 | Ota et al. | 162/207 |
| 4,639,292 | 1/1987 | Ota et al. | 162/375 |
| 4,748,736 | 6/1988 | Miihkinen | 29/527.2 |
| 4,912,835 | 4/1990 | Harada et al. | 29/132 |
| 5,167,068 | 12/1992 | Leino et al. | 29/895.32 |
| 5,171,404 | 12/1992 | Ellis et al. | 162/206 |
| 5,176,940 | 1/1993 | Salo et al. | 427/202 |
| 5,223,099 | 6/1993 | Salo | 162/207 |
| 5,252,185 | 10/1993 | Ellis et al. | 162/206 |
| 5,272,821 | 12/1993 | Orloff et al. | 34/110 |
| 5,353,521 | 10/1994 | Orloff | 34/110 |
| 5,456,946 | 10/1995 | Snellman | 427/272 |

FOREIGN PATENT DOCUMENTS

| | | |
|---|---|---|
| 886644 | 11/1971 | Canada . |
| 960543 | 1/1975 | Canada . |
| 56-159390 | 12/1981 | Japan . |

*Primary Examiner*—Karen M. Hastings
*Attorney, Agent, or Firm*—George J. Primak

[57] ABSTRACT

The invention overcomes the problem of paper edge overdrying during the paper drying process on paper machine drying cylinders. It comprises applying a thin ceramic coating onto the circumferential exterior surface of the cylinder near the cylinder edges, thereby forming a thermal barrier coating which decreases paper drying rate at said edges and reduces or eliminates paper edge overdrying.

33 Claims, 2 Drawing Sheets

APPLICATION OF THERMAL BARRIER COATINGS TO PAPER MACHINE DRYING CYLINDERS TO PREVENT PAPER EDGE OVERDRYING

BACKGROUND OF THE INVENTION

1. Field of the Invention

The present invention relates to a method for reducing or eliminating the problem of edge overdrying which occurs during the drying process in the manufacture of paper. It also includes a paper machine drying cylinder which is suitably coated to achieve this objective.

2. Description of the Prior Art

Conventional paper machine drying sections comprise a large number (40 to 60) of rotating, steam-heated cast iron cylinders arranged in two tiers. Paper is dried to solids content around 93% by alternately pressing the top and bottom sides of the paper web against these cylinders as it passes through the dryer in a serpentine fashion. The tendency of overdrying the paper edges is a common problem which affects almost all newsprint, fine paper and specialty grade paper machines. Without any compensation for this effect, the typical cross-machine direction (CD) moisture profile of the paper is non-uniform because of the lower moisture content of the edges of the sheet.

Non-uniform CD moisture profiles lead to non-uniform CD paper properties. In particular, problems with dimensional stability, cockle, curl, grainy edges, and damaged fibers may arise. These are undesirable in the final papermaking steps as well as in the final printing and converting operations. Overdried edges are also problematic in another way, namely they are a cause of web breaks that lead to decreased machine productivity.

There are a number of factors which combine to create the problem of overdried edges. The relative importance of these factors varies from machine to machine. Starting with the forming and pressing operations, a low basis weight (dry mass) or a low moisture content at the edge of the production section will invariably result in overdried edges.

In the drying section, the passage of the cool, wet paper on the steam-heated cylinders reduces the cylinder surface temperature. However at the cylinder edges, where there is no contact with paper, the temperature can be considerably higher than in the paper covered areas. Heat flows by conduction from the overheated cylinder edges towards the paper, resulting in localized overdrying in at least several inches of the paper edges. In addition to overdrying resulting from heat transfer phenomena, mass transfer considerations are also important. The improved ventilation and decreased humidity of the ventilating air at the dryer edges (compared to the central portion) may also lead to overdried paper edges, although in this case the problem is generally less localized. Improper operation of the cylinders especially with respect to steam condensate removal can cause non-uniform CD moisture profiles, but not restricted necessarily to the paper edges.

In some cases, overdried edges are cut off and returned to the pulper, which decreases productivity. Some commonly used operational type of solutions to the problem of overdried edges are modification of the basis weight and/or moisture profile coming out of the forming and pressing sections, and CD moisture profile control methods such as remoisturizing. Although the formation of a sheet with heavier edges will result in a uniform moisture profile, it does so by producing a non-uniform dry basis weight which results in non-uniform CD properties. The high cost of furnish is a further deterrent to this solution. The production of a non-uniform moisture profile after the press section through the use of steam showers means that expensive equipment and control systems must be purchased and installed in a physically constrained area. The wetter sheet edges often lead to sheet breaks. Finally, the use of profiling water showers in the dryer section is an expensive, maintenance intensive option which increases the steam usage in the dryer section and often leads to wrinkles at the paper edges.

The concept of using insulating material on the interior peripheral surface at both ends of the drying cylinder to prevent overdrying of the paper web edges is described for example in U.S. Pat. No. 4,379,369; in this example the insulation is held in place by adhesive or vulcanizing. Despite the fact that several companies offer an internally installed drying cylinder insulation system to prevent edge overdrying using either spring-loaded rods or an adhesive to secure the insulation, only a few installations are known to have been made to date. The use of such insulators has not become popular for a number of reasons. Paper machine operators are hesitant to install equipment inside a cylinder since it can not be easily inspected and has the potential of causing severe damage to the cylinder. As well, even though the inside surface of the cylinder is insulated, heat can still conduct through the thick (1 to 2 inch) cast iron wall of the cylinder resulting in high temperatures at the cylinder edges.

The installation of various foil, fabric or sheet material on the outside surface edges of the cylinder for the purpose of preventing edge overdrying is described, for example, in U.S. Pat. Nos. 4,192,080, 4,639,291 and 4,639,292. The material is secured to the cylinder surface with glue. The disadvantages of this technique include the non-permanent method of attachment, the large fabric thickness and/or number of treated cylinders required to accomplish the desired effect, and the lack of ability to vary the degree of surface temperature correction. There are no known commercial users of this technique.

Numerous patents describe the insulation by various means of the drying cylinder end faces, rather than of the cylinder periphery at the ends (e.g. U.S. Pat. Nos. 4,450,631 and 4,399,169). Unlike the present invention, the purpose of those patents is to prevent heat loss from the end plates of the drying cylinders; however with the advent of enclosed dryer sections this is now rarely a concern.

Other approaches to preventing paper edge overdrying include tightening the dryer felt at the center, modifying the CD permeability of the dryer felt (e.g. Canadian patent 960,543), and altering the traditional design of the cast iron drying cylinder. With respect to this last approach, the prior art describes, for example, cylinders with internal compartments at the ends that are heated with lower temperature fluid than the rest of the cylinder (Canadian patent 886,644), and cylinders with grooves or channels to allow condensate build-up near the ends (Japanese Kokai 159,390/81). Some of these methods are difficult or impossible to retrofit to existing paper machine drying sections.

Coatings are utilized for a variety of reasons on many types of paper machine rolls, although the prior art does not appear to describe any applications of coatings for paper machine drying cylinders. In all cases known to the applicants, the coating is applied across the entire width of a roll in a uniform fashion and is thus unable to address the problem of surface temperature non-uniformity. The usual intent is to improve the adhesion/release properties, surface finish, or corrosion/wear resistance. Several examples of coatings on rolls described in the prior art are given below.

U.S. Pat. Nos. 4,748,736 and 5,167,068 describe methods of coating a roll with metallic/ceramic surface with adhesion/release properties suitable for replacing the conventionally used granite press rolls. The coating of a roll, especially press and calender rolls, with a resilient polymer followed by a wear resistant layer to control hardness/wear resistance is described in U.S. Pat. No. 5,176,940. U.S. Pat. Nos. 5,252,185 and 5,171,404 describe a thermally applied tungsten carbide or chromium carbide coating on a heated calender roll to provide an abrasive resistant surface. U.S. Pat. Nos. 5,353,521 and 5,272,821 describe the coating of a heated impulse drying roll surface to lower its thermal diffusivity, where impulse drying is that process where a wet paper web passes through a press nip with one of the rolls heated to a high (200° C. to 400° C.) temperature. After impulse drying the sheet solids content is typically 40% to 60%. The low thermal diffusivity of the roll is said to suppress sheet delamination (sheet splitting) by substantially reducing the extent of energy transfer in the later stages of the impulse drying process, thereby reducing the energy available for flash evaporation.

U.S. Pat. No. 5,223,099 describes a method of combining a roll coating and an external heating device such that the heating radiation penetrates through the paper to the roll face, but does not heat the roll at a depth greater than the roll face. The invention is to be used for example on a press or calender roll, with the particular objective of being able to better control the detachment of the web from the roll surface by controlling the surface temperature.

For rolls used in the tissue rather than papermaking industry, full-face thermal spray coatings of molybdenum or stainless steel for Yankee tissue drying cylinders have been used for about 15 years to prevent corrosion and wear.

For rolls not used in the paper industry, U.S. Pat. No. 4,912,835 describes a thermally sprayed cermet coating on rolls used in the manufacture of metal sheets, with the objective of providing the right coefficient of friction and durability to enhance productivity.

OBJECTS AND SUMMARY OF THE INVENTION

It is an object of the present invention to obviate the disadvantages of the prior art and to provide a simple and efficient solution to the problem of overdried paper edges by applying a thin ceramic coating onto the circumferential exterior surface of paper drying cylinders near the cylinder edges, thereby forming a thermal barrier coating at the edges which decreases paper drying rate at said edges and reduces or eliminates paper edge overdrying.

Another object is to control the drying temperature at the edge of the cylinder by providing a thermal barrier coating which is suitably graded in the cross-direction of the cylinder.

Other objects and advantages of the invention will become apparent from the following description thereof.

The solution to the problem of overdried paper edges according to the present invention involves the surface application of a thin ceramic layer to the edges of drying cylinders in order to physically engineer the heat transfer characteristics of the cylinders. Specifically, this new approach involves the thermal spraying of a ceramic thermal barrier coating (TBC) on the edges of the drying cylinder not covered by paper and also for a certain distance under the area where the paper runs on the cylinder. This creates a thermal insulation and reduces the heat transferred to the paper edges from the overheated cylinder edges.

The thickness of the coating is preferably graded in the cross-direction of the cylinder, so that there is no step change in thickness and no significant gradient change in temperature across the cylinder. The TBC thickness required to effect the desired reduction in dryer cylinder surface temperature depends on the non-uniformity of the dryer surface temperature profile; typically a temperature reduction of the order of 6° C. per 100 μm thickness of TBC can be expected. The graded coating is thickest at the outer edge where overheating is greatest.

Moreover, there is preferably provided a bond coat between the cylinder surface and the TBC to reduce the stress caused by the difference in thermal expansion of the cylinder base material and the ceramic coating. This bond coat usually consists of a material whose thermal expansion closely matches the thermal expansion of the ceramic coating, and preferably has a low porosity to prevent diffusion of oxygen or other chemicals into the base material of the cylinder, normally cast iron. This bond coat will generally have a thickness from about 20 to 100 μ and preferably 50–60 μm, and will usually be a metal alloy such as an alloy of nickel, chromium or cobalt. For example an alloy made of Ni and containing 5% Al is particularly suitable as the bond coat. Also, it is desirable that the bond coat should have a surface roughness of 7–12 μm to provide a satisfactory adhesion between the bond coat and the ceramic coating. The bond coat is usually applied onto the cylinder by thermal spraying such as plasma spraying. The cylinder is usually sandblasted prior to the bond coat application.

The ceramic coating itself will be selected from suitable ceramic materials such as titanium oxide, zirconium oxide, aluminum oxide and chromium oxide. A particularly preferred material is a partially stabilized zirconia, such as $ZrO_2$ partially stabilized with $Y_2O_3$. The thickness of the ceramic coating is normally varied between 0 and 400 μm depending on the surface temperature drop required in the cross direction of the cylinder.

Preferably the ceramic coating has 10%–30% porosity to reduce the thermal conductivity of the coating and prevent propagation of stress induced cracks and the surface roughness of the ceramic coating is maintained generally below 7 μm to avoid damage to the paper contacting the cylinder. Such ceramic coatings are usually applied to the surface of the cylinder or onto the surface of the bond coat, by thermal spraying, such as plasma spaying which may be carried out by means of a plasma torch. Preferably the ceramic coating is applied in multiple passes of the plasma torch, each pass depositing a ceramic layer 10–50 μm thick. Obviously a paper machine drying cylinder having such ceramic coating or TBC near the edges of the cylinder is part of the present invention.

There are many advantages to the solution described herein. This modern approach does not require disassembly of the dryer cans, has no risk of detachment and yet can be removed, if necessary. There are no moving parts or operating costs. This invention requires no control package, water/steam supply, maintenance or special care by mill personnel once installed. It is easily optimized, and does not mark the paper. Rather than masking the problem or correcting it after it occurs, this solution prevents the formation of overdried edges by lowering the dryer cylinder edge temperature. This lowers the heat transfer to the paper and decreases the drying rate at the edges.

BRIEF DESCRIPTION OF THE DRAWINGS

A preferred embodiment of the invention will now be described with reference to the appended drawings, in which.

DESCRIPTION OF THE PREFERRED EMBODIMENT

The preferred embodiment of the invention is illustrated, but not limited by the appended drawings where the same reference numbers are used to describe the same parts in all figures.

Figure 1:
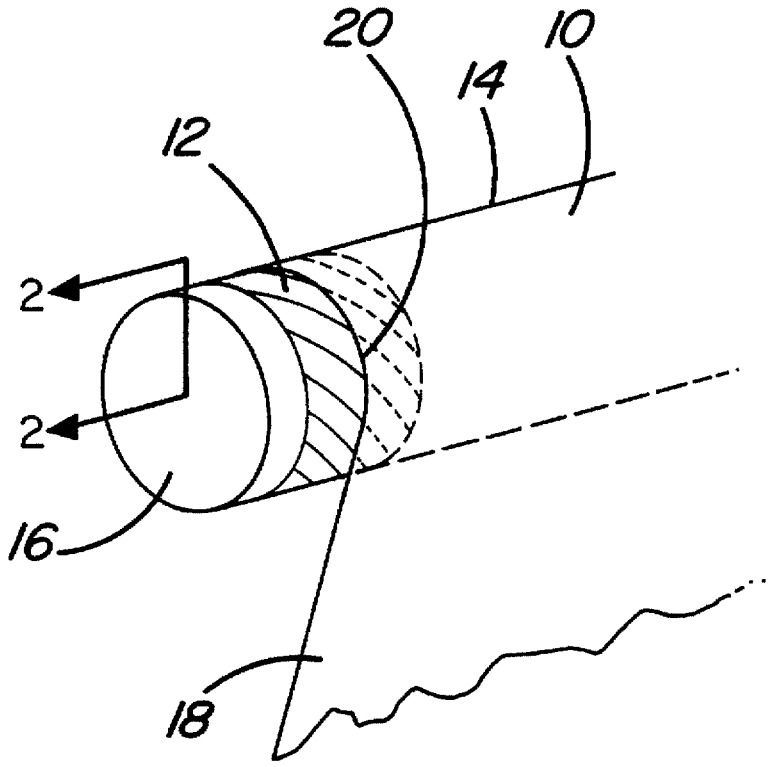
FIG. 1 represents a partial schematic view, in perspective, of a paper machine drying cylinder, coated at one of its edges with a ceramic coating in accordance with the present invention.

Referring to FIG. 1, it illustrates a paper machine drying cylinder 10 with a TBC ceramic coating 12 applied on the circumferential external surface 14 near the edge or extremity 16 of the drying cylinder 10. The paper sheet 18 passes on the cylinder surface 14 so that the edge 20 of the sheet stays on top of the TBC.

Figure 2:
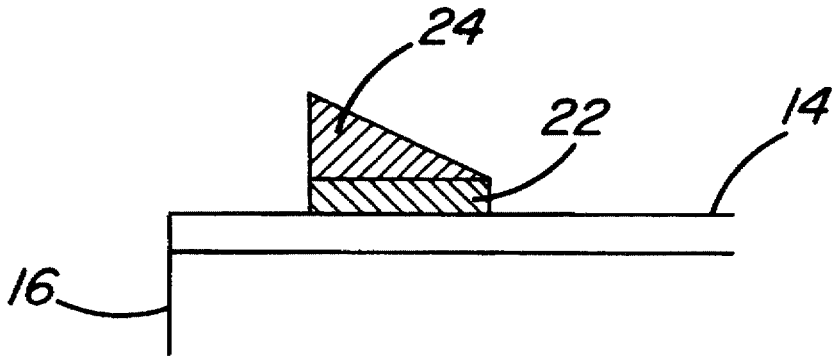
FIG. 2 is a view along section 2—2 of FIG. 1, showing the coating on an enlarged scale.

The preferred coating 12 consists of two distinct layers 22 and 24 and is applied on the circumferential outer surface 14 near the drying cylinder extremity 16, as shown in FIG. 2, which is not drawn to scale. The first layer 22 which is applied directly onto the prepared surface 14 of the cylinder 10 in a uniformly thick layer, is the bond coat. The second layer 24 is a thermal barrier coating (TBC) which is applied on top of the bond coat 22 in a graded fashion. The characteristics of the coating 12 which are critical in determining the coating's performance include: (i) thickness of bond and TBC layers; (ii) porosity of bond and TBC layers; (iii) adhesion strength; (iv) surface roughness; and (v) thermal insulating characteristics.

As mentioned above, prior to the application of the thermal barrier coating 24, a bond coat 22 may be used. The bond coat 22 is applied directly on the surface 14 of the drying cylinder 10 in order to reduce the stress in the coating caused by the difference in the thermal expansion of the cylinder's base material (cast iron) and the ceramic layer. The bond coating 22 composition can consist of a variety of nickel and/or cobalt based alloys. The preferred material for this application is Ni containing 5% Al. The bond coat should be made of a material whose thermal expansion closely matches the thermal expansion of the ceramic TBC layer. Furthermore, the preferred bond layer is resistant to oxidation and corrosion in the operating environment. The preferred bond layer for this application is a Ni-5% Al, however, other nickel, chromium and cobalt alloys could be used. The preferred thickness of the bond layer is 60 μm, however, the thickness could be varied from about 20–100 μm. The porosity of the bond layer should be as low as possible to prevent diffusion of oxygen or other chemicals into the base material. The adhesion of the bond layer to the cast iron base material is improved by sandblasting and cleaning the cast iron prior to the application of the bond layer. The bond coat is usually applied onto the cylinder by thermal spraying, such as plasma spraying.

A wide variety of ceramics could be used as thermal barriers. The oxides of metals such as titanium, zirconium, aluminum and chromium are relatively inexpensive and, therefore, their application as thermal barrier coatings is economically feasible. The preferred material is partially stabilized zirconia ($ZrO_2$). Zirconia has very low thermal conductivity and good wear resistance. As such, zirconia is the material of choice for thermal barrier coatings used in the aerospace and gas turbine industries. However, zirconia exhibits three well-defined polymorphs: the monoclinic, tetragonal, and cubic phases. The monoclinic phase is stable up to about 1170° C. where it transforms to the tetragonal phase. At 2370° C. the tetragonal phase transforms to the cubic phase. The concern is that as the zirconia is being sprayed it is heated to temperatures near its melting point (2680° C.). Upon cooling it transforms back to its monoclinic phase and grows in volume by 3 to 5%. This expansion can result in cracking and coating detachment. Thus additives, such as calcia (CaO), magnesia (MgO), yttria ($Y_2O_3$), or ceria ($CeO_2$) must be mixed with the zirconia to stabilize the material in either the tetragonal or the cubic phase. The material preferred for this application is $ZrO_2$-8%$Y_2O_3$.

The preferred TCB layer has 10%–30% porosity. The porosity is used to reduce the thermal conductivity of the TBC layer and to prevent the propagation of stress-induced cracks. The thickness of the TBC ceramic layer can be varied according to the temperature drop required. The reduction in surface temperature which can be obtained using $ZrO_2$-8%$Y_2O_3$TBC with 20% porosity, at the heat flux and surface temperature which is typical of an operating drying cylinder, has been measured at 6° C. per 100 μm of TBC thickness. The preferred thickness of the TBC layer is varied between 0 and 400 μm depending on the surface temperature drop required in the cross direction profile of the drying cylinder.

The preferred surface roughness of the bond layer is 7–12 μm which is controlled by selecting suitable size powders for spraying and optimizing the spraying parameters. The roughness of the bond layer is important in determining the adhesion strength between the bond layer and the TBC layer. The preferred adhesion of the TBC layer is in excess of 8 MPa. The surface roughness of the TBC layer is maintained below 7 μm by controlling the size of the powders used and the operating parameters during spraying. Excessive surface roughness of the TBC layer may damage the paper contacting the cylinder.

Both the bond coat and the ceramic coating can be applied on dryer cylinders using a number of thermal spraying technologies, such as, plasma spraying, high-velocity oxy-fuel (H.V.O.F.), and flame spraying. The preferred application process for the purpose of the present invention is plasma spraying. In the preferred coating application process, the plasma torch is attached to a torch moving mechanism. During spraying, the mechanism moves the torch across the length of the cylinder in a preprogrammed routine, while the cylinder is rotated. The duration of spraying, the spraying rate, the rotational velocity of the cylinder, and the linear velocity of the moving torch are controlled to obtain the desired coating thickness. The coating is applied in multiple passes, each pass depositing a bond layer of 20–100 μm thick or a TBC layer 10–50 μm thick.

In the preferred coating application process, the plasma torch is used to generate a jet whose temperature is in excess of 5000° C. and whose velocity is in excess of 100 m/sec. The selected powder is fed into the plasma jet through a powder feeder and a powder injector. The powder is entrained by the plasma jet, where it is melted and accelerated towards the cylinder's surface. On the cylinder, the powder splats, cools and solidifies into a TBC layer.

The number of cylinders to be treated depends on the extent of the edge overdrying problem, the operating characteristics of the particular dryer, and the corrected temperature profile after the coating application. The number will typically range from 2 to 10, with a coating applied at each extremity of the cylinder. The width of cylinder coated depends on the area of the cylinder which is overheated and the distance of the paper from the cylinder edge.

Figure 3:
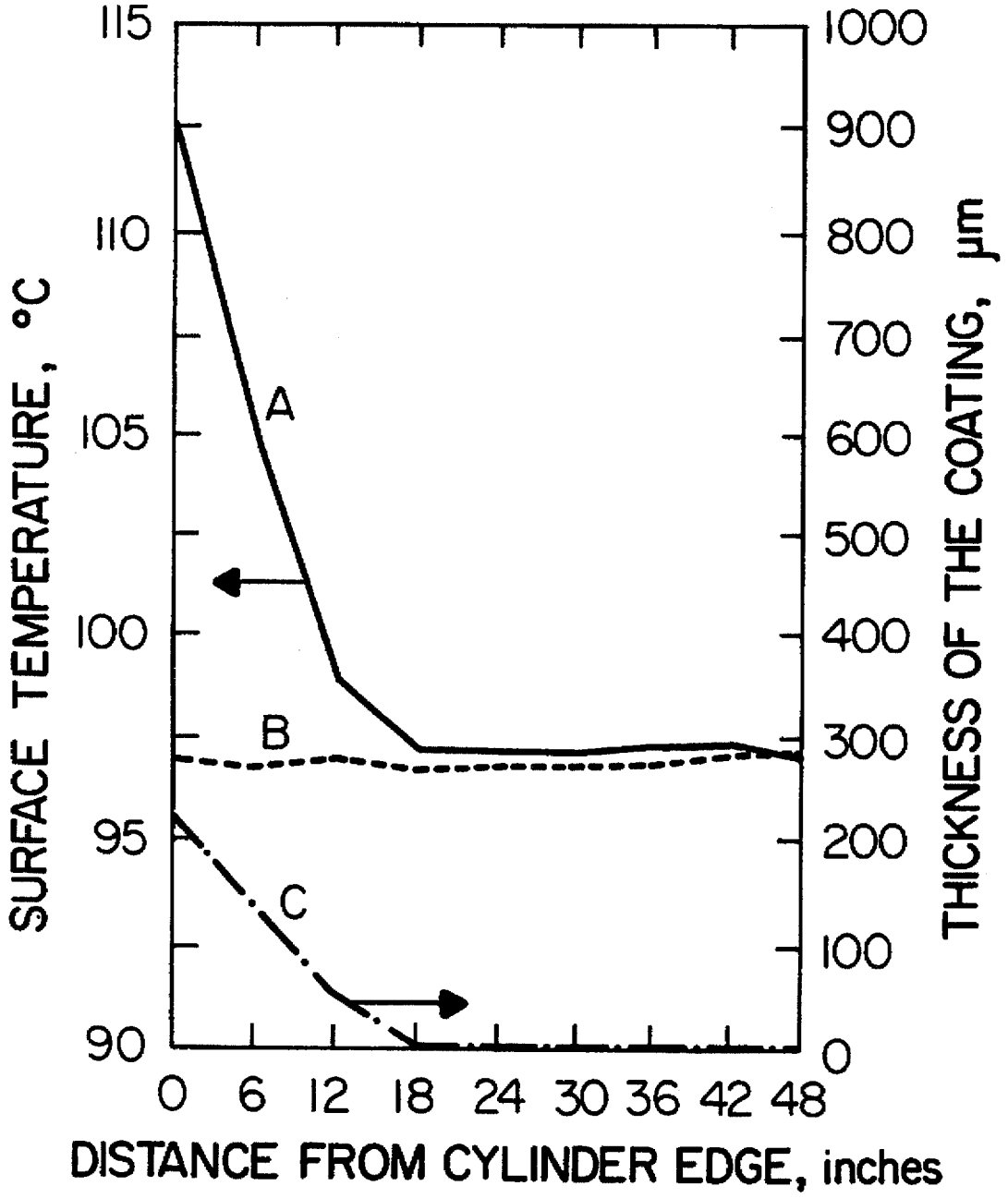
FIG. 3 represents a graph showing the variation of drying cylinder surface temperature with and without ceramic coating and the thickness of the coating as a function of distance from the cylinder edge.

FIG. 3 represents a graphical illustration of results achieved with the present invention in an example which is described below.

EXAMPLE

FIG. 3 shows the non-uniform temperature profile (line A) of a typical drying cylinder as measured in a mill environment. Line B shows an example of a temperature profile achieved with a TBC of the present invention and line C shows the TBC thickness required to achieve this profile, based on laboratory results. In this example it can be seen that the coating thickness varies from about 225 microns at the edge of the cylinder to 0 microns 18 inches from the edge.

It should be understood that the invention is not limited to the specific embodiments described above, but that many modifications obvious to those skilled in the art can be made without departing from the spirit of the invention and the scope of the following claims.

We claim:

1. A method of reducing or eliminating paper edge overdrying during a paper drying process on paper machine drying cylinders, which comprises applying a thin ceramic coating onto the circumferential exterior surface of the cylinders only near the cylinder edges, thereby forming a thermal barrier coating at the edges, the thickness of said thermal barrier coating being graded in cross-direction of the cylinder so as to avoid a step change in said thickness and a significant gradient change in temperature across the cylinder, with the graded coating being thickest at outermost edges of the cylinder where overheating is greatest.

2. A method according to claim 1, wherein the ceramic coating is provided partly on cylinder edge surface which is not covered by paper during the paper drying process, and partly on cylinder edge surface which is covered by paper during the paper drying process.

3. A method according to claim 1, wherein the ceramic coating is applied onto the surface of the cylinders by thermal spraying.

4. A method according to claim 1, wherein a bond coat is provided between the cylinder surface and the thermal barrier coating to reduce the stress caused by the difference in thermal expansion of cylinder base material and the ceramic coating, said bond coat consisting of a material whose thermal expansion closely matches the thermal expansion of the ceramic coating.

5. A method according to claim 4, wherein the material of said bond coat has a low porosity to prevent diffusion of oxygen or other chemicals into the base material of the cylinder.

6. A method according to claim 4, wherein the bond coat has a thickness from about 20–100 μm.

7. A method according to claim 6, wherein the thickness of said bond coat is 50–60 μm.

8. A method according to claim 4, wherein the bond coat is made of a material selected from the group consisting of nickel, chromium and cobalt alloys.

9. A method according to claim 4, wherein the bond coat is made of Ni containing 5% Al.

10. A method according to claim 4, wherein the bond coat has a surface roughness of 7–12μm to provide a satisfactory adhesion between the bond coat and the ceramic coating.

11. A method according to claim 1, wherein ceramic material of the ceramic coating is selected from the group consisting of titanium oxide, zirconium oxide, aluminum oxide and chromium oxide.

12. A method according to claim 11, wherein the ceramic material is a partially stabilized zirconia.

13. A method according to claim 12, wherein the partially stabilized zirconia is $ZrO_2$ partially stabilized with $Y_2O_3$.

14. A method according to claim 1, whereby the ceramic coating has 10%–30% porosity to reduce the thermal conductivity of said coating and prevent propagation of stress induced cracks.

15. A method according to claim 1, wherein the thickness of the ceramic coating is varied between 0 and 400 μm depending on the surface temperature drop required in the cross direction of the cylinder.

16. A method according to claim 1, wherein the surface roughness of the ceramic coating is below 7 μm to avoid damage to paper contacting the cylinder.

17. A method according to claim 4, wherein the ceramic coating is applied onto the surface of the bond coat, by thermal spraying.

18. A method according to claim 17, wherein the thermal spraying is plasma spraying carried out by means of a plasma torch.

19. A method according to claim 18, wherein the ceramic coating is applied in multiple passes of the plasma torch, each pass depositing a ceramic layer 10–50 μm thick.

20. A method according to claim 4, wherein the bond coat is applied onto the surface of the cylinder by thermal spraying.

21. A method according to claim 20, wherein the thermal spraying is plasma spraying carried out by means of a plasma torch.

22. A method according to claim 21, wherein the bond coat is applied in a single pass of the plasma torch, depositing a bond layer 20–100 μm thick.

23. A method according to claim 20, wherein the cylinder surface onto which the bond coat is applied is sandblasted prior to the bond coat application.

24. A paper machine drying cylinder having a thin ceramic coating on its circumferential outer surface, only near the cylinder edges, said coating being structured and arranged to form a thermal barrier at the cylinder edges, which decreases paper drying rate at said edges and thereby reduces or eliminates paper edge overdrying, the thickness of said ceramic coating being graded in cross-direction of the cylinder so as to avoid a step change in said thickness and a significant gradient change in temperature across the cylinder, with the graded coating being thickest at outermost edges of the cylinder where overheating is greatest.

25. A paper machine drying cylinder according to claim 24, wherein the thickness of the ceramic coating varies between 0 and 400 μm depending on the surface temperature drop required in the cross direction of the cylinder.

26. A paper machine drying cylinder according to claim 24, wherein a bond coat is provided between the cylinder surface and the ceramic coating to reduce the stress caused by the difference in thermal expansion of cylinder base material and the ceramic coating.

27. A paper machine drying cylinder according to claim 26, wherein the bond coat has as thickness from about 20 to 100 μm.

28. A paper machine drying cylinder according to claim 26, wherein the bond coat is made of a material selected from the group consisting of nickel, chromium and cobalt alloys.

29. A paper machine drying cylinder according to claim 26, wherein the bond coat is made of Ni with 5% Al.

30. A paper machine drying cylinder according to claim 24, wherein ceramic material of the ceramic coating is selected from the group consisting of titanium oxide, zirconium oxide, aluminum oxide and chromium oxide.

31. A paper machine drying cylinder according to claim 30, wherein the ceramic material is partially stabilized zirconia.

32. A paper machine drying cylinder according to claim 31, wherein the partially stabilized zirconia is $ZrO_2$ partially stabilized with $Y_2O_3$.

33. A paper machine drying cylinder according to claim 24, wherein the surface roughness of the ceramic coating is below 7 μm to avoid damage to the paper contacting the cylinder.

* * * * *